US008444098B2

(12) United States Patent
Parello et al.

(10) Patent No.: US 8,444,098 B2
(45) Date of Patent: May 21, 2013

(54) BALLOON HOLDER CADDY SYSTEMS

(76) Inventors: James Parello, Hamilton, NJ (US); Dale Parello, Hamilton, NJ (US)

( * ) Notice: Subject to any disclaimer, the term of this patent is extended or adjusted under 35 U.S.C. 154(b) by 0 days.

(21) Appl. No.: 13/369,464

(22) Filed: Feb. 9, 2012

(65) Prior Publication Data

US 2012/0211614 A1 Aug. 23, 2012

Related U.S. Application Data

(60) Provisional application No. 61/443,789, filed on Feb. 17, 2011.

(51) Int. Cl.

| | |
|---|---|
| ***A47B 96/06*** | (2006.01) |
| ***A47G 29/00*** | (2006.01) |
| ***A47K 1/00*** | (2006.01) |

(52) U.S. Cl.

USPC ..... 248/218.4; 248/220.21; 248/223.41; 248/224.7; 248/224.8; 248/309.1; 446/220; 446/222; 24/30.5

(58) Field of Classification Search

USPC ..... 248/220.21, 223.41, 224.7, 224.8, 248/309.1; 24/30.5; 446/220, 222

See application file for complete search history.

(56) References Cited

U.S. PATENT DOCUMENTS

| | | | | |
|---|---|---|---|---|
| 3,092,388 | A * | 6/1963 | Wagenheim | 273/380 |
| 3,178,138 | A * | 4/1965 | Hessdoerfer et al. | 248/539 |
| 4,335,490 | A * | 6/1982 | Teachout | 24/114.5 |
| 4,881,916 | A | 11/1989 | Houser | |
| 4,936,532 | A * | 6/1990 | Williams | 248/205.3 |
| 5,295,891 | A | 3/1994 | Schalk | |
| 5,306,194 | A | 4/1994 | Epstein | |
| 7,249,991 | B1 * | 7/2007 | Watson | 446/220 |
| D610,208 | S * | 2/2010 | Hou | D21/453 |
| 7,708,616 | B2 | 5/2010 | Phillips | |
| 2005/0207168 | A1 | 9/2005 | Chabert | |
| 2006/0240740 | A1 | 10/2006 | Rouse | |

* cited by examiner

*Primary Examiner* — Amy J Sterling

(74) *Attorney, Agent, or Firm* — RG Patent Consulting LLC; Rachel Gillory

(57) ABSTRACT

A balloon holder caddy system designed to simulate the look of Helium-filled balloons, to reduce the safety hazards associated with traveling with Helium-filled balloons in the passenger compartment of an automobile, and to eliminate repeated trips to a base location and back (a product use location such as is common with real estate agent's sign postings.) Balloon holder caddy system comprises a top gang-clip with multiple balloon neck receiving slots for creating a balloon cluster, a rod for elevating the balloon cluster simulating helium filled balloons, and an intermediate leg gripper and a base gripper for attaching to a sign-post leg using re-useable/releasable zip-ties. The system providing a unique and efficient balloon displaying means.

19 Claims, 5 Drawing Sheets

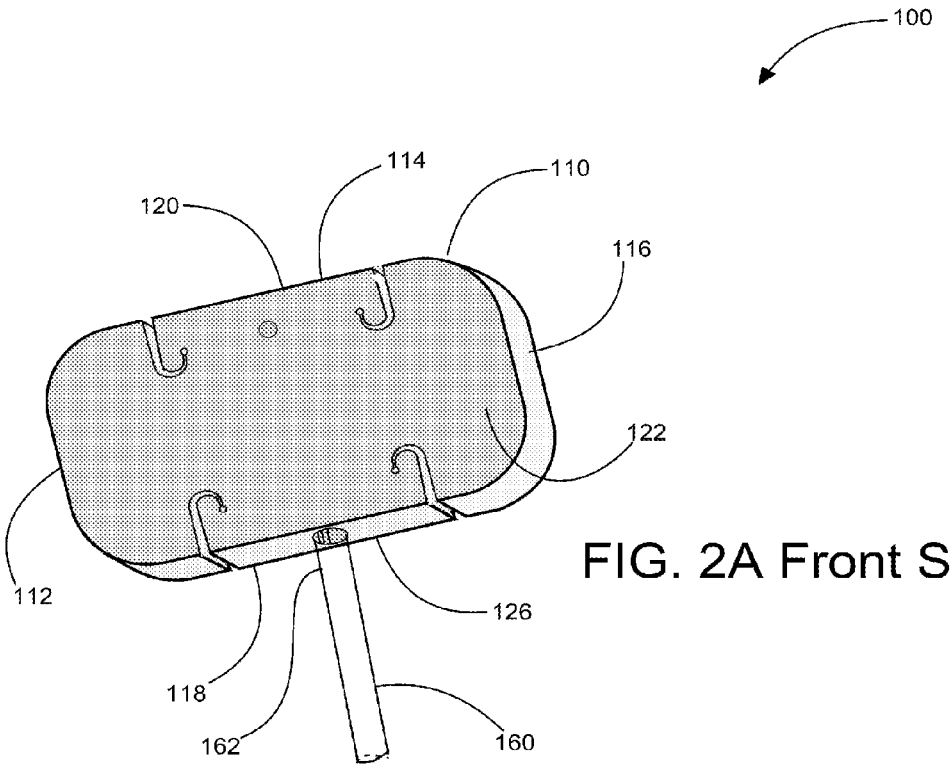
FIG. 2A Front Side
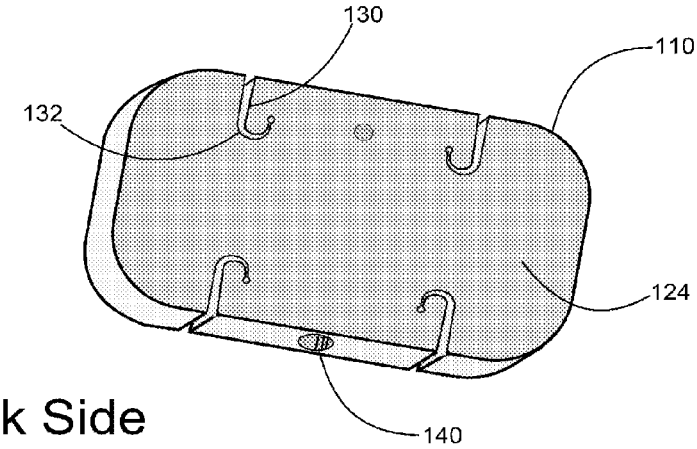
FIG. 2B Back Side

BALLOON HOLDER CADDY SYSTEMS

CROSS-REFERENCE TO RELATED APPLICATION

The present application is related to and claims priority from prior provisional application Ser. No. 61/443,789, filed Feb. 17, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of balloon holders and more specifically relates to balloon holder/caddy systems.

2. Description of the Related Art

Balloons have been popular novelty items for many years, being most popular among children. The bright colors and light weight of balloons have fascinated children from the ages of nearly infancy all the way to teenage years. Helium filled balloons seem to fascinate every age group. Balloons have become synonymous with parties because of their widespread use at parties and events that bring joy. When a person driving down the road happens upon a cluster of balloons unexpectedly, the first thought that comes to mind is that there is a party nearby. Because of the nearly universal use of balloons at parties and happy events, balloons automatically create a favorable image in the minds of people of all ages. Because of this and the fact that they are so visible, it has also become popular for people to attract attention to sales events using balloons. Signs have been adorned with balloons to bring attention to what is on the sign. A sign with balloons attached to it draws quick attention to the sign and automatically seems to say, "Everyone welcome." Some businesses have even developed a permanent and continuous use for balloons as a sales enhancer.

Many individuals like to decorate signs with balloons to catch the attention of people to let them know they are headed in the right direction for events or parties. In order for the balloons to stand upright above a sign, they must be filled with helium. This can be expensive and time consuming, especially for real estate agents who may add balloons to their signs. Also, air-filled balloons can be used more than once as long as they don't pop, whereas helium balloons can only be used once. Additionally, when setting up signs, a helium-filled balloon could potentially float away, leaving individuals without their full display. Individuals may tape stick balloons to displays, however this may not be ideal.

Helium-filled balloons seem to have the most popularity, not just at parties, but for drawing attention to signs. Helium is a gas that is lighter than air and is typically sold in compressed cylinders. These cylinders are very heavy and when purchased, can only be stored in a convenient and safe location, and the balloons brought to the container to be filled. It may be impractical to move a Helium cylinder around from location to location to fill balloons. While Helium-filled balloons are associated with parties and happiness, the heavy weight of Helium cylinders has been responsible for many back lifting injuries. The cylinders also have a high compressed gas pressure and have to be treated with strict safety precautions. Another resulting safety concern, is filling balloons with Helium, placing them in a vehicle with the occupants, and driving. Vision can become completely obstructed by floating balloons that get loose. A less expensive and considerably safer alternative to Helium-filled balloons is desirable.

Various attempts have been made to solve the above-mentioned problems such as those found in U.S. Pat. Nos. 2006/0240740; 5,306,194; 4,881,916; 7,708,616; 2005/0207168; and 5,295,891. This prior art is representative of balloon holders. None of the above inventions and patents, taken either singly or in combination, is seen to describe the invention as claimed.

Ideally, a balloon holder should be easy to set up and display, and yet, would operate reliably and be manufactured at a modest expense. Thus, a need exists for a reliable balloon holder and display system to simulate helium filled balloons yet reduce the associated safety hazards, and to avoid the above-mentioned problems.

BRIEF SUMMARY OF THE INVENTION

In view of the foregoing disadvantages inherent in the known balloon holder art, the present invention provides a novel balloon holder caddy system. The general purpose of the present invention, which will be described subsequently in greater detail, is to simulate the aesthetic appearance of helium filled balloons yet avoiding the expenses, and associated safety hazards.

Balloon holder caddy system can aerially support balloons and attach them to signs and various objects to signify parties, sales to any and all items, real estate showings, yard sales, reunions, and other events. The device effectively eliminates the need for helium balloons, as it can stabilize regular balloons in the air above a sign or object. By using this device, individuals can save time and money by purchasing regular balloons as opposed to helium balloons, but will not have to sacrifice their aesthetically pleasing appeal. Real estate agents or individuals who use balloons to decorate signs for various events will appreciate the convenience and appeal that this product affords, as it calls attention to such signs or events.

The disclosed balloon holder caddy system, in a preferred embodiment, may comprise a top gang-clip having a first side-edge, a second side-edge, a third side-edge, a fourth side-edge, a bottom side, a top side, a front side, a back side, at least one balloon neck receiving slot, a first rod aperture, and a rod having a proximate end and a distal end. The proximate end and the distal end define the length of the rod. The balloon holder caddy system also preferably comprises at least one intermediate leg gripper having a second rod aperture and a first re-useable fastener and a base leg gripper having a third rod aperture and second re-useable fastener. The first re-useable fastener and the second re-useable fasteners may comprise re-useable zip-ties. The first side-edge, the second side-edge, the third side-edge, the bottom side, the top side, the front side, and the back side define parameters of the top gang-clip. The thickness of the top gang-clip comprises a relatively flat (low) profile.

The Balloon Caddy has at least one balloon neck receiving slot of the top gang-clip comprises a hook-shaped tapered slot-opening having an apostrophe-shaped guide traversing from the first side-edge and the second side-edge allowing frictional ingress and frictional egress of a balloon neck. The balloon necks are able to be stretched-inserted through the hook-shaped tapered slot-opening and removably wedged into at least one balloon neck receiving slot when the balloon neck is stretch-held after the frictional ingress. At least one the balloon neck is able to be stretched-inserted through any one of the hook-shaped tapered slot-openings and removably wedged into the balloon neck receiving slot in the top gang-clip from the front side toward the back side or from the back side toward the front side having balloons removably attached both on the front side and on the back side.

The first rod aperture of the top gang-clip is preferably located in the bottom side of the top gang-clip, the first rod aperture comprising an interference-fit with the proximate end of the rod, and the rod is removably insertable into the first rod aperture such that the rod is coupled to the top gang-clip. The intermediate leg gripper having the first re-useable fastener is slidable and insertable via the second rod aperture onto the rod to a user-preferred position(ing) and the first re-useable fastener is releasable and fastened (fastenable) to a sign post leg or other fixed or movable object. The first re-useable fastener and the second re-useable fastener may comprise a release button enabling a two-way movement (also making them re-usable) of the zip-tie(s) straps through a one-way strap-lock. The intermediate leg gripper comprises a through hole such that the rod is able to pass therethrough.

The rod in preferred embodiments is about 4 feet long and about ¼ inch in diameter and may comprise fiberglass in the preferred embodiment, but may comprise other materials such as plastic or other suitable equivalent in other embodiments. The rod is flexible in certain embodiments and rigid in other embodiments. The intermediate leg gripper and the base leg gripper comprise a rectangular through-hole such that the first re-useable fastener and the second re-useable fastener respectively are able to pass therethrough to secure the intermediate leg gripper and the base leg gripper to a common sign-post leg. The base leg gripper comprises a receiver, the third rod aperture, for receiving the rod which has an interference fit with the distal end of the rod such that the rod is able to be push-inserted into the third rod aperture in the upper-side of the base leg gripper so that the rod and the base leg gripper are removably attached.

The base leg gripper, in a preferred embodiment, is removably attachable to a vertical column such as a sign post leg or other structure via the second re-useable fastener. An alternate embodiment may comprise a chair leg bracket for displaying balloons vertically. The base leg gripper, the intermediate leg gripper, and the top gang-clip also may comprise plastic in a preferred embodiment. The balloon holder caddy system is usable to removably attach at least one balloon to the top gang-clip via at least one balloon slot. The rod is able to be removably attached to the sign post leg via the intermediate leg gripper and the base leg gripper such that the balloon holder caddy system is usable to display balloon(s).

A method of use for the balloon holder caddy system is also disclosed herein and may comprise the steps of: friction-inserting a proximate end of the rod into the first rod aperture; sliding the intermediate leg gripper onto the rod through the second rod aperture; friction-inserting the distal end of the rod into the third rod aperture in the base leg gripper; removably fastening the first re-useable fastener on the intermediate leg gripper and the second re-useable fastener on the base leg gripper around the sign post leg (or other structure); stretch-inserting at least one balloon(s) neck into the balloon neck receiving slot and stretch-releasing the balloon(s) neck; and displaying the balloon holder caddy system with the balloon (s) attached.

The present invention holds significant improvements and serves as a balloon holder caddy system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, balloon holder caddy system, constructed and operative according to the teachings of the present invention.

FIGS. 2A and 2B are perspective views illustrating a top gang-clip of the balloon holder caddy system with a rod according to an embodiment of the present invention of FIG. 1.

The various embodiments of the present invention will hereinafter be described in conjunction with the appended drawings, wherein like designations denote like elements.

DETAILED DESCRIPTION

As discussed above, embodiments of the present invention relate to a balloon holder device and more particularly to a balloon holder caddy system as used to simulate helium-filled balloons, reducing wasted time, reducing environmental pollution and improving the associated safety issues, yet providing an aesthetically-pleasing display means.

Generally speaking, a balloon holder caddy system allows individuals to use regular balloons, as opposed to helium-filled balloons, to decorate signs for real estate showings, parties, and other events. Balloon holder caddy system can comprise a small rectangular base that can be made from hard plastic with a drilled hole. There can be a second smaller hole in the base, partially drilled, measuring approximately ¼" in diameter. Inserted into this hole can be a fiberglass rod ranging from 2' to 10' long. Attached to the top of the fiberglass rod can be a square, hard piece of plastic with four "J" shape slits and four small holes. To use, individuals can place an object, such as a pole, through the fully drilled hole at the bottom of the base. They can then blow up standard balloons and slip them through the slits (of the specially designed top piece) on the top of the fiberglass rod. The device is then ready for display.

Figure 1:
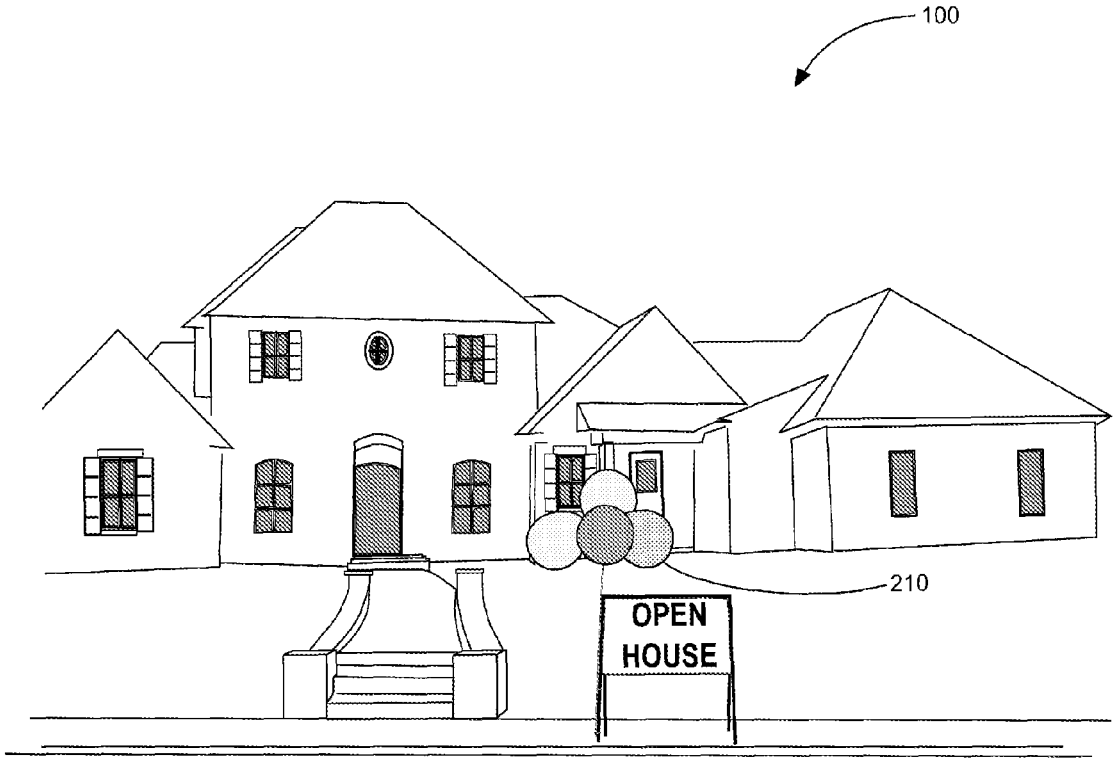
FIG. 1 shows a perspective view illustrating an in-use condition of a balloon holder caddy system according to an embodiment of the present invention.

Referring to the drawings by numerals of reference there is shown in FIG. 1, a perspective view illustrating an in-use condition of balloon holder caddy system 100 according to an embodiment of the present invention.

Balloon holder caddy system 100 may comprise top gang-clip 110 comprising first side-edge 112, second side-edge 114, at least third side-edge 116, (in triangular versions and a fourth side-edge 126 in square versions—more or less sides may be used in alternate embodiments for example circles, hexagons, and the like) bottom side 118, top side 120, front side 122, and back side 124. Top gang-clip 110 further comprises at least one balloon neck receiving slot 130, and first rod aperture 140. Rod 160 has proximate end 162 and distal end 164 wherein proximate end 162 and distal end 164 define the length of rod 160.

Balloon holder caddy system 100 may also comprise at least one intermediate leg gripper 170 having second rod aperture 150 and first re-useable fastener 180, base leg gripper 190 having third rod aperture 199 and second re-useable fastener 200. First side-edge 112, second side-edge 114, third side-edge 116, bottom side 118, top side 120, front side 122, and back side 124 define parameters of top gang-clip 110. At least one balloon neck receiving slot 130 of top gang-clip 110 preferably comprises hook-shaped tapered slot-opening 132 traversing from first side-edge 112 and second side-edge 114 allowing frictional ingress and frictional egress of balloon(s) 210 neck. Balloon(s) 210 necks are able to be stretched-inserted through hook-shaped tapered slot-opening 132 and removably wedged into balloon neck receiving slot 130 when balloon 210 neck is stretch-released after frictional ingress. In this way the present invention may be used to hold balloon(s) 210 in place, as desired for display.

First rod aperture 140 of top gang-clip 110 is located in bottom side 118 of top gang-clip 110, first rod aperture 140 comprising an interference-fit with proximate end 162 of rod 160, and rod 160 is removably insertable into first rod aperture 140 such that rod 160 is coupled to top gang-clip 110. Intermediate leg gripper 170 having first re-useable fastener 180 is (slidable) slideably insertable via second rod aperture 150 onto rod 160 to a user preferred position and first re-useable fastener 180 is releasably fastenable to sign post leg 220. Base leg gripper 190 having third rod aperture 199 has an interference fit with distal end 164 of rod 160 such that rod 160 is push-inserted into third rod aperture 199 in an upper-side of base leg gripper 190 such that rod 160 and base leg gripper 190 are removably attached. Balloon holder caddy system 100 is usable to removably attach at least one balloon 210 to top gang-clip 110 via at least one balloon neck receiving slot 130 and rod 160 is able to be removably attached to sign post leg 220 (or other fixed or moveable objects) via intermediate leg gripper 170 and base leg gripper 190 such that balloon holder caddy system 100 is usable to display balloon(s) 210 (in an elevated position.)

Referring now to FIGS. 2A and 2B, perspective views illustrating top gang-clip 110 of balloon holder caddy system 100 with rod 160 according to an embodiment of the present invention of FIG. 1.

Top gang-clip 110 may comprise fourth side-edge 126 but may have only third side-edge 116 in some embodiments, or top gang-clip 110 may be circular in yet other embodiments, as mentioned previously. The thickness of top gang-clip 110 may be less than the width or the height providing a low profile in a front side-up position. Top gang-clip 110 may be positioned upright (first side-edge 112 up) in an in-use condition and have a rectangular shape in preferred embodiments. At least one balloon(s) 210 neck is able to be stretched-inserted through any one of hook-shaped tapered slot-openings 132 and removably wedged into balloon neck receiving slot 130 in top gang-clip 110 from front side 122 toward back side 124 and from back side 124 toward front side 122 providing a preferred option of removably attaching balloon(s) 210 on front side 122 and on back side 124 of top gang-clip 110 giving balloon(s) 210 cluster the appearance of Helium balloon(s) 210 while hiding top gang-clip 110 from view.

Figure 3:
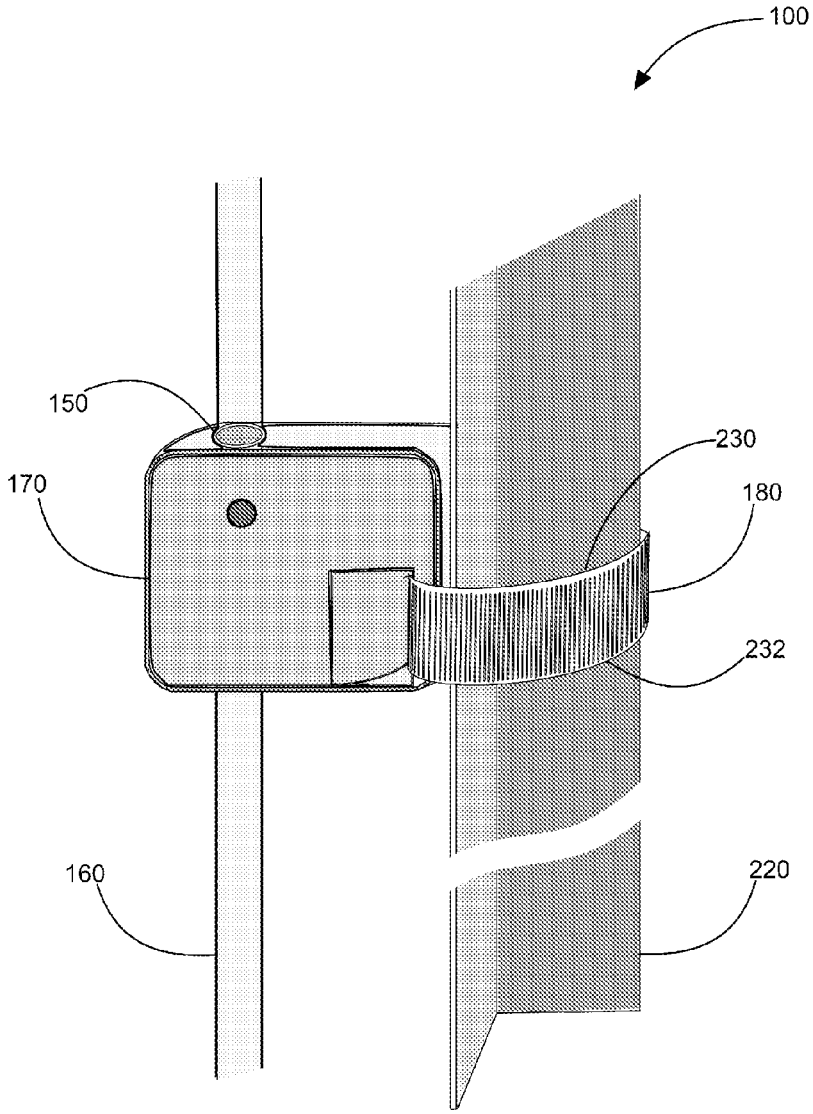
FIG. 3 is a perspective view illustrating an intermediate leg gripper with the rod, of the balloon holder caddy system according to an embodiment of the present invention of FIG. 1.

Referring now to FIG. 3, a perspective view illustrating intermediate leg gripper 170 with rod 160 of balloon holder caddy system 100 according to an embodiment of the present invention of FIG. 1.

First re-useable fastener 180 and second re-useable fastener 200 may comprise releasable zip-ties 230. Intermediate leg gripper 170 comprises a through hole so that rod 160 is able to pass therethrough. First re-useable fastener 180 and second re-useable fastener 200 comprises release buttons enabling two-way movement of zip-tie straps 232 through a one-way strap-lock. Intermediate leg gripper 170 and base leg gripper 190 may comprise a rectangular or a round through-hole such that first re-useable fastener 180 and second re-useable fastener 200 respectively are able to pass therethrough to secure intermediate leg gripper 170 and base leg gripper 190 to a common sign post leg 220.

Figure 4:
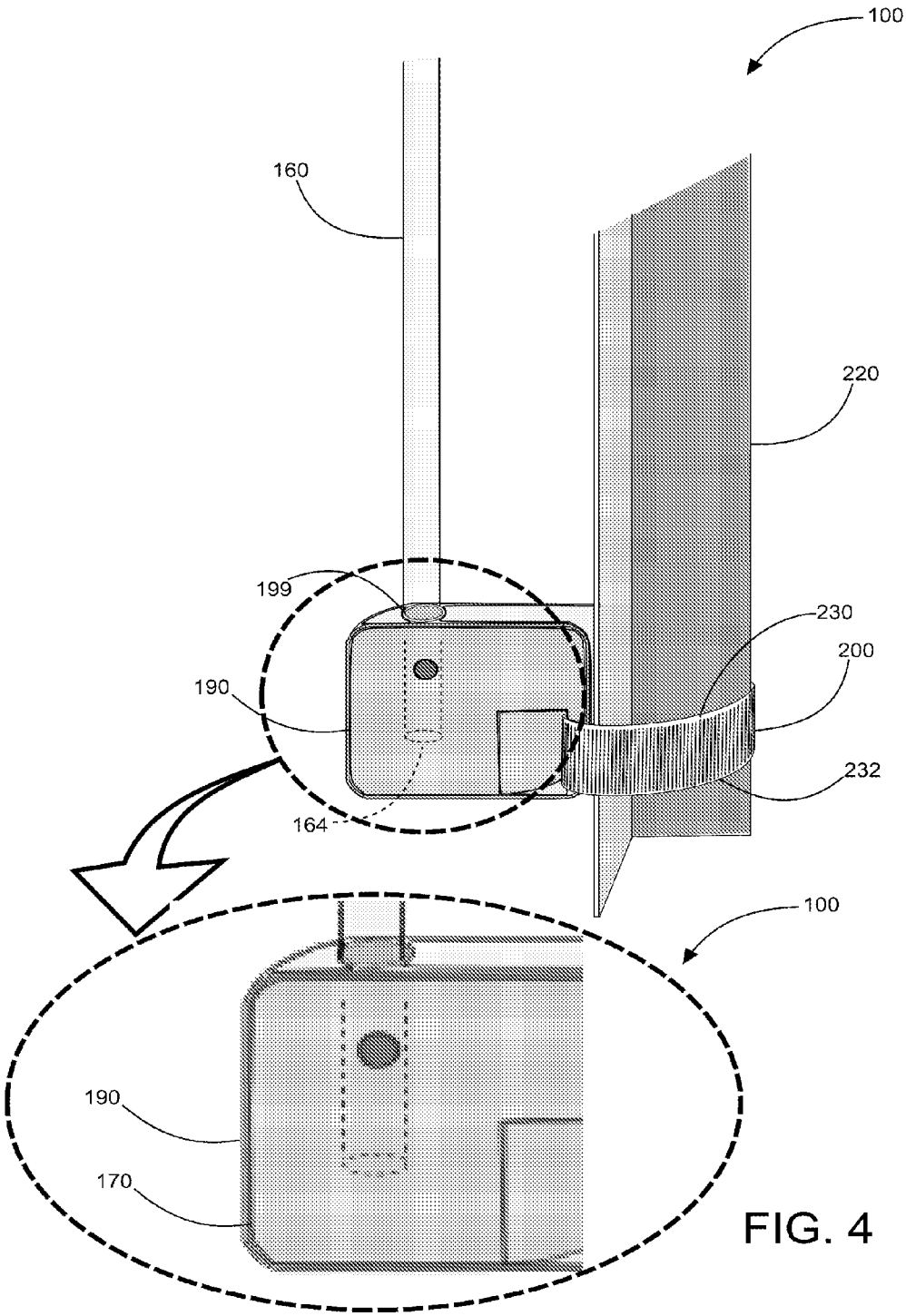
FIG. 4 is a perspective view illustrating a base leg gripper with the rod, of the balloon holder caddy system according to an embodiment of the present invention of FIG. 1.

Referring now to FIG. 4, a perspective view illustrating base leg gripper 190 with rod 160 of balloon holder caddy system 100 according to an embodiment of the present invention of FIG. 1.

Base leg gripper 190 comprises a leg receiver for rod 160. Base leg gripper 190 may comprise a mass suitable to stay at least one balloon(s) 210 relative to a planar surface (ground, floor, or the like) in preferred embodiments. Rod 160 may be about 4 feet long and about ¼ inch in diameter and preferably comprise fiberglass, but may comprise plastic in other embodiments. Base leg gripper 190 is removably attachable to a vertical column via second re-useable fastener 200 and base leg gripper 190, intermediate leg gripper 170, and top gang-clip 110 may comprise plastic or other suitable equivalent material.

Balloon holder caddy system 100 according to an embodiment of the present invention of FIGS. 1-4, may be sold as kit 450 comprising the following parts: at least one top gang-clip 110; at least one rod 160; at least one intermediate leg gripper 170; at least one base leg gripper 190; at least two zip ties 180 & 200; and at least one set of user instructions. Balloon holder caddy system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
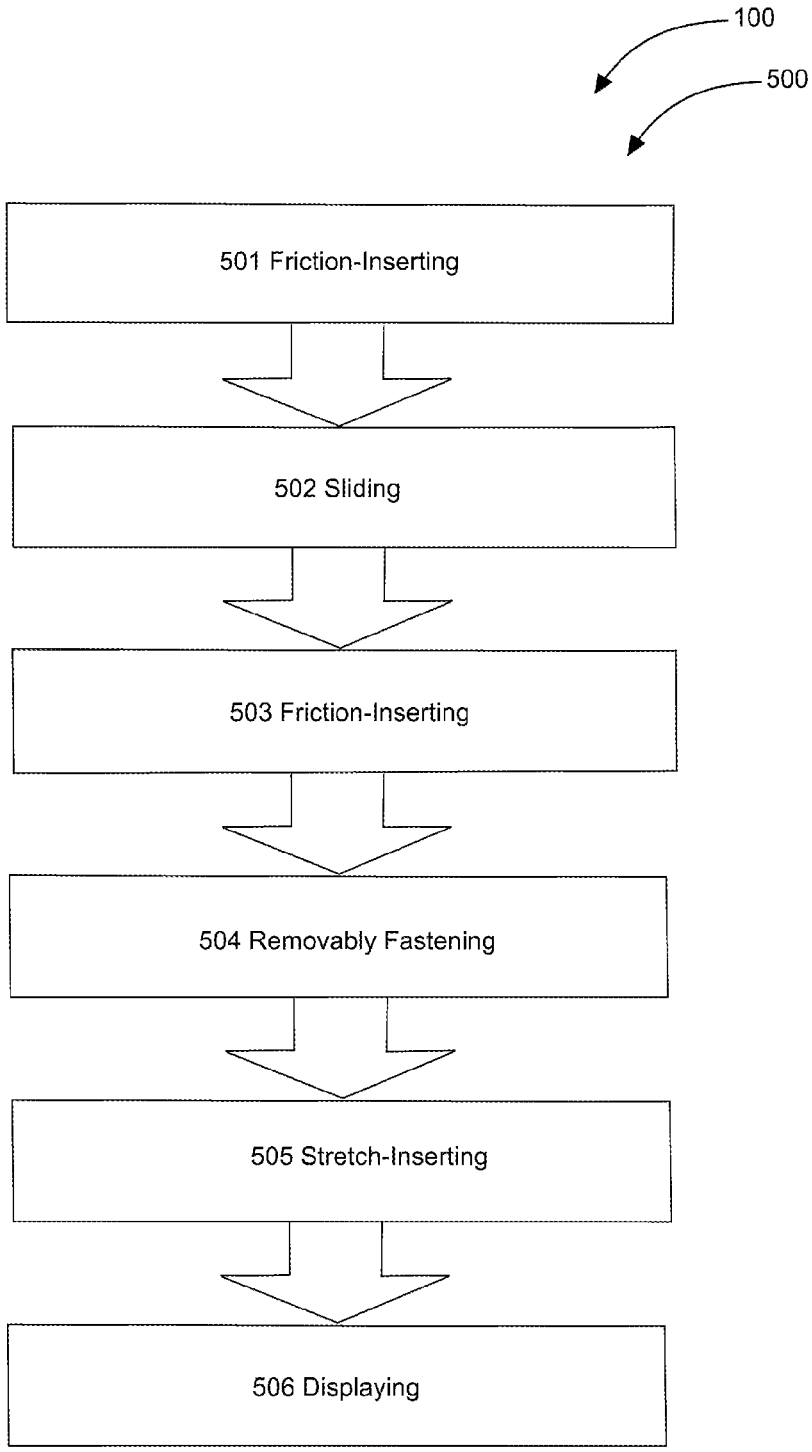
FIG. 5 is a flowchart illustrating a method of use of the balloon holder caddy system according to an embodiment of the present invention of FIGS. 1-4.

Referring now to FIG. 5, a flowchart illustrating a method of use 500 of balloon holder caddy system 100 according to an embodiment of the present invention of FIGS. 1-4.

A method of use 500 of balloon holder caddy system 100 may comprise the steps of: step one 501 friction-inserting a proximate end 162 of rod 160 into first rod aperture 140; step two 502 sliding intermediate leg gripper 170 onto rod 160 through second rod aperture 150; step three 503 friction-inserting distal end 164 of rod 160 into third rod aperture 199 in base leg gripper 190; step four 504 removably fastening first re-useable fastener 180 on intermediate leg gripper 170 and second re-useable fastener 200 on base leg gripper 190 around sign post leg 220; step five 505 stretch-inserting at least one balloon(s) 210 neck into balloon neck receiving slot 130 and stretch-releasing balloon(s) 210 neck; and step six 506 displaying balloon holder caddy system 100 with balloon (s) 210 attached thereto.

It should be noted that steps 501 and 503 can be performed in interchangeable order. It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A balloon holder caddy system comprising:

a top gang-clip comprising;

a first side-edge;

a second side-edge;

at least a third side-edge;

a bottom side;

a top side;

a front side;

a back side;

at least one balloon neck receiving slot; and a first rod aperture;

a rod having a proximate end and a distal end wherein said proximate end and said distal end define a length of said rod;

at least one intermediate leg gripper having a second rod aperture and a first re-useable fastener; and a base leg gripper having a third rod aperture and a second re-useable fastener;

wherein said first side-edge, said second side-edge, said third side-edge, said bottom side, said top side, said front side, and said back side define parameters of said top gang-clip;

wherein said at least one balloon neck receiving slot of said top gang-clip comprises a hook-shaped tapered slot-opening traversing from said first side-edge and said second side-edge allowing frictional ingress and frictional egress of a balloon necks;

wherein said balloon necks are able to be stretched-inserted through said hook-shaped tapered slot-opening and removably wedged into said balloon neck receiving slot when said balloon neck is stretch-released after said frictional ingress;

wherein said first rod aperture of said top gang-clip is located in said bottom side of said top gang-clip, said first rod aperture comprising an interference-fit with said proximate end of said rod, and said rod is removably insertable into said first rod aperture such that said rod is coupled to said top gang-clip;

wherein said intermediate leg gripper having said first re-useable fastener is slideably insertable via said second rod aperture onto said rod to a user preferred position and said first re-useable fastener is releasably fastenable to a sign post leg;

wherein said base leg gripper comprises a third rod aperture is interference fit with said distal end of said rod such that said rod is push-inserted into said third rod aperture in an upper-side of said base leg gripper such that said rod and said base leg gripper are removably attached; and wherein said balloon holder caddy system is usable to removably attach at least one said balloon to said top gang-clip via said at least one balloon slot and wherein said rod is able to be removably attached to said sign post leg via said intermediate leg gripper and said base leg gripper such that said balloon holder caddy system is usable to display said balloon(s).

2. The balloon holder caddy system of claim 1 wherein said top gang-clip further comprises a fourth side-edge.

3. The balloon holder caddy system of claim 1 wherein said first re-useable fastener and said second re-useable fasteners comprise zip-ties.

4. The balloon holder caddy system of claim 1 wherein said intermediate leg gripper comprises a through hole so that said rod is able to pass therethrough.

5. The balloon holder caddy system of claim 1 wherein said base leg gripper comprises a leg receiver for said rod.

6. The balloon holder caddy system of claim 1 wherein said base leg gripper comprises a mass suitable to stay at least one said balloon relative to a planar surface.

7. The balloon holder caddy system of claim 3 wherein said first re-useable fastener and said second re-useable fastener comprises release buttons enabling two-way movement of straps of said zip-ties through a one-way strap-lock.

8. The balloon holder caddy system of claim 1 wherein said rod is about 4 feet long.

9. The balloon holder caddy system of claim 8 wherein said rod is about ¼ inch in diameter.

10. The balloon holder caddy system of claim 1 wherein said rod comprises fiberglass.

11. The balloon holder caddy system of claim 1 wherein said rod is flexible.

12. The balloon holder caddy system of claim 1 wherein said base leg gripper is removably attachable to a vertical column via said second re-useable fastener.

13. The balloon holder caddy system of claim 1 wherein said base leg gripper, said intermediate leg gripper, and said top gang-clip comprise plastic.

14. The balloon holder caddy system of claim 1 wherein a thickness of said top gang-clip is less than a width or a height of said top gang-clip providing a low profile.

15. The balloon holder caddy system of claim 1 wherein said rod is plastic.

16. The balloon holder caddy system of claim 1 wherein said intermediate leg gripper and said base leg gripper comprise a rectangular through-hole such that said first re-useable fastener and said second re-useable fastener respectively are able to pass therethrough to secure said intermediate leg gripper and said base leg gripper to a common said sign post leg.

17. The balloon holder caddy system of claim 1 wherein at least one said balloon neck is able to be stretched-inserted through any one of said hook-shaped tapered slot-openings and removably wedged into said balloon neck receiving slot in said top gang-clip from said front side toward said back side and from said back side toward said front side providing said balloons are able to be removably attached on said front side and on said back side of said top gang-clip.

18. A balloon holder caddy system comprising:

a top gang-clip comprising;
- a first side-edge;
- a second side-edge;
- a third side-edge;
- a fourth side-edge;
- a bottom side;
- a top side;
- a front side;
- a back side;
- at least one balloon neck receiving slot; and
- a first rod aperture;

a rod having a proximate end and a distal end wherein said proximate end and said distal end define a length of said rod;

at least one intermediate leg gripper having a second rod aperture and a first re-useable fastener;

a base leg gripper having a third rod aperture and a second re-useable fastener;

wherein said first re-useable fastener and said second re-useable fasteners comprise zip-ties;

wherein said first side-edge, said second side-edge, said third side-edge, said bottom side, said top side, said front side, and said back side define parameters of said top gang-clip;

wherein the thickness of said top gang-clip comprises a flat profile;

wherein said at least one balloon neck receiving slot of said top gang-clip comprises a hook-shaped tapered slot-opening comprising an apostrophe-shaped guide traversing from said first side-edge and said second side-edge allowing frictional ingress and frictional egress of a balloon necks;

wherein said balloon necks are able to be stretched-inserted through said hook-shaped tapered slot-opening and removably wedged into said at least one balloon neck receiving slot when said balloon neck is stretch-held after said frictional ingress;

wherein at least one said balloon neck is able to be stretched-inserted through any one of said hook-shaped tapered slot-openings and removably wedged into said balloon neck receiving slot in said top gang-clip from said front side toward said back side and from said back side toward said front side having said balloons removably attached both on said front side and on said back side;

wherein said first rod aperture of said top gang-clip is located in said bottom side of said top gang-clip, said first rod aperture comprising an interference-fit with said proximate end of said rod, and said rod is removably insertable into said first rod aperture such that said rod is coupled to said top gang-clip;

wherein said intermediate leg gripper having said first re-useable fastener is slideably insertable via said second rod aperture onto said rod to a user-preferred position and said first re-useable fastener is releasably fastenable to a sign post leg;

wherein said first re-useable fastener and said second re-useable fastener comprises release buttons enabling two-way movement of straps said zip-tie(s) through a one-way strap-lock;

wherein said intermediate leg gripper comprises a through hole such that said rod is able to pass therethrough;

wherein said rod is about 4 feet long;

wherein said rod is about ¼ inch in diameter;

wherein said rod comprises fiberglass;

wherein said intermediate leg gripper and said base leg gripper comprise a rectangular through-hole such that said first re-useable fastener and said second re-useable fastener respectively are able to pass therethrough to secure said intermediate leg gripper and said base leg gripper to a common said sign-post leg;

wherein said base leg gripper comprises a leg receiver for receiving said rod;

wherein said base leg gripper comprises said third rod aperture and has an interference fit with said distal end of said rod such that said rod is able to be push-inserted into said third rod aperture in an upper-side of said base leg gripper such that said rod and said base leg gripper are removably attached;

wherein said base leg gripper is removably attachable to a vertical column via said second re-useable fastener;

wherein said base leg gripper, said intermediate leg gripper, and said top gang-clip comprise plastic; and wherein said balloon holder caddy system is usable to removably attach at least one said balloon to said top gang-clip via said at least one balloon slot and wherein said rod is able to be removably attached to said sign post leg via said intermediate leg gripper and said base leg gripper such that said balloon holder caddy system is usable to display said balloon(s).

19. The balloon holder caddy system of claim 18 further comprising a kit having:

said top gang-clip;

said rod;

said at least one intermediate leg gripper;

said at least one base leg gripper;

said first re-useable fastener;

said second re-useable fastener; and a set of user instructions.

* * * * *